United States Patent [19]

Haloila

[11] Patent Number: 4,587,796

[45] Date of Patent: May 13, 1986

[54] PACKAGING MACHINE

[75] Inventor: Matti Haloila, Mynämäki, Finland

[73] Assignee: Oy M. Haloila AB, Finland

[21] Appl. No.: 602,007

[22] Filed: Apr. 19, 1984

[30] Foreign Application Priority Data

Apr. 21, 1983 [FI] Finland ..... 831375

[51] Int. Cl.[4] ..... B65B 13/04

[52] U.S. Cl. ..... 53/588; 53/176

[58] Field of Search ..... 53/176, 211, 298, 299, 53/441, 449, 504, 556, 587, 588

[56] References Cited

U.S. PATENT DOCUMENTS

| | | | |
|---|---|---|---|
| 2,845,763 | 8/1958 | Wonsidler | 53/157 |
| 4,109,445 | 8/1978 | Shulman | 53/210 |
| 4,232,501 | 11/1980 | Stackhouse | 53/441 |
| 4,432,185 | 2/1984 | Geisinger | 53/587 |
| 4,450,668 | 5/1984 | Grossi | 53/449 |

FOREIGN PATENT DOCUMENTS

| | | | |
|---|---|---|---|
| 0022135 | 1/1981 | European Pat. Off. | 53/211 |
| 2348768 | 6/1974 | Fed. Rep. of Germany | 53/504 |
| 2493802 | 5/1982 | France | 53/587 |

*Primary Examiner*—James F. Coan

*Attorney, Agent, or Firm*—Steinberg & Raskin

[57] ABSTRACT

Apparatus for packaging articles in film material includes a frame structure and a mechanism for wrapping film material around a stationary article received in the frame structure. The mechanism includes a rotatable frame assembly mounted for rotation in the frame structure and apparatus for rotating the same. A roll of film material is mounted on the rotatable frame assembly along with braking and diverting rolls. A gripping device is provided to selectively engage and release the film material during rotation of the rotatable frame assembly. The rotatable frame assembly is itself mounted in a support frame arranged in the frame structure for reciprocating movement in up and down directions, i.e., the support frame carrying the rotatable frame assembly can be raised and lowered. A cut-off and seaming device is provided for cutting the film material and for seaming or affixing the cut-off end thereof. A pressing device is arranged to be descendable onto the article being packaged.

6 Claims, 2 Drawing Figures

PACKAGING MACHINE

BACKGROUND OF THE INVENTION

The present invention relates generally to apparatus for packaging articles in film material, such as plastic film material, and more particularly to apparatus for packaging articles in film material wherein the film material is wrapped around the article while the article is stationary.

Two different basic methods are employed in the packaging of articles by wrapping such articles with film material. In a first method the article being packaged is placed on a rotatable base and the packaging film material is wrapped around the article by rotating the article on the base while the film material is payed out.

A drawback of this technique is that it is difficult to hold the product fixed with respect to the rotating base during the wrapping operation. Moreover, automation of such a packaging technique is difficult and expensive due in part to the various ancillary components required, such as label applicators and pressing devices. It is also difficult to draw the topside film material of the package by means of a unit separate from the rotating means. Still further, the arrangements for conveying the articles to be packaged to the packaging apparatus are cumbersome. Still another drawback is that safety hazards are presented during the operation of these types of arrangements so that relatively wide safety zones are required during operation.

The second main type of arrangement used in packaging articles by wrapping the same in film material is where the article being packaged is maintained stationary while the film material is wrapped around the stationary article by means of a type of crankshaft mechanism having a rotatable shaft.

The greatest drawback in arrangements according to the second method is the difficulty of applying the topside film material upon the article being packaged. As in the case of the first method described above, the use of a label applicator and pressing device causes numerous problems and the safety hazards presented during operation are even greater than those presented by the first technique.

SUMMARY OF THE INVENTION

It is an object of the present invention to provide new and improved apparatus for packaging articles in film material.

It is a principal object of the present invention to provide new and improved apparatus for packaging articles in film material which overcome the problems and drawbacks of the conventional packaging arrangements described above.

Briefly, in accordance with the present invention these and other objects are attained by providing apparatus including a frame structure adapted to receive an article to be wrapped in film material and means for wrapping film material around the article which include a rotatable frame assembly mounted for rotation in the frame structure and means for rotating the rotatable frame assembly.

A roll of film material is mounted on the rotatable frame assembly together with braking and diverting rolls. A gripping device mounted in the frame structure selectively engages the film material during rotation of the rotatable frame assembly and to subsequently release the film material.

The rotatable frame assembly on which the film material roll is mounted is itself mounted on a support frame which is mounted for up and down reciprocation in the frame structure and a pressing device is disposed so as to descend on the article being packaged during wrapping. A topside film material roll and cooperating gripping, pulling and cutting means provide a topside film material sheet over the article. Cut-off and seaming means cut the film material and seam or affix the cut-off end thereof.

DESCRIPTION OF THE DRAWINGS

A more complete appreciation of the present invention and many of the attendant advantages thereof will be readily understood by reference to the following detailed description when considered in connection with the accompanying drawings in which.

DETAILED DESCRIPTION OF THE PREFERRED EMBODIMENTS

Figure 1:
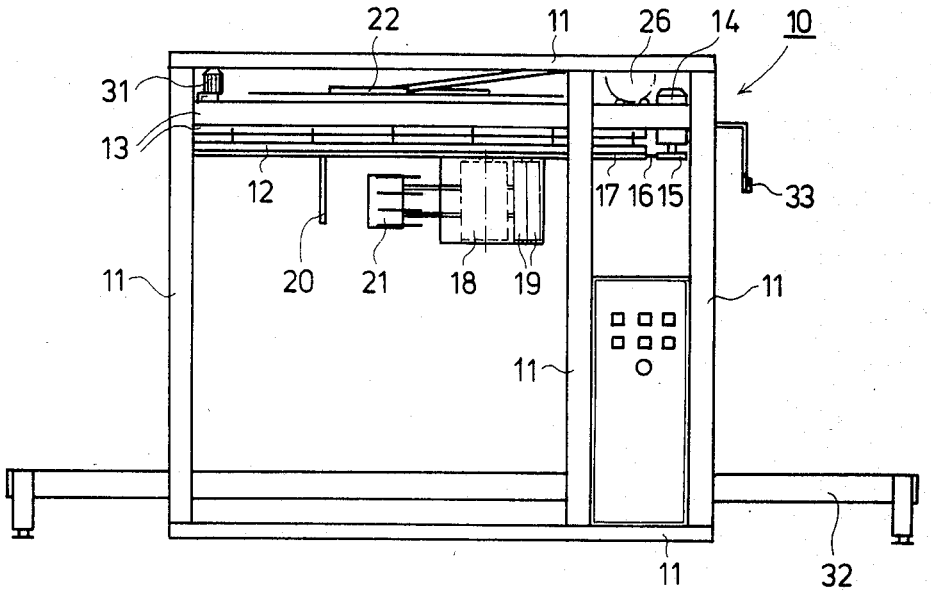
FIG. 1 is an elevational view of an embodiment of apparatus in accordance with the present invention with certain components thereof illustrated in FIG. 2 being omitted for the sake of clarity.

Referring now to the drawings wherein like reference characters designate identical or corresponding parts throughout the several views, apparatus for packaging articles in film material in accordance with the present invention, generally designated 10, are illustrated. In accordance with the basic principle of the invention, the apparatus includes frame structure 11 in which is disposed a rotatable frame assembly 12 mounted for rotation by means of a motor 14 and associated belt pulley 15, a pulley 17 forming part of the frame assembly 12 and belt 16 trained over pulleys 15 and 17. The rotatable frame assembly 12 is itself supported by a non-rotating support frame 13 mounted in the frame structure 11. As seen in FIG. 1, the motor 15 is mounted on the support frame 13.

A roll of film material 18 and braking and diverting rolls 19 are mounted on the rotatable frame assembly 12. The rolls 19 maintain a tension in the film material as it is payed out from the roll 18. A gripping member 20 is provided in the frame structure 11 mounted on support frame 13 for engaging the film material during rotation of the rotatable frame assembly 12 to cause the film material to be payed out from the roll 18 as the frame assembly rotates. The gripping member 20 is adapted to release the film material at an appropriate time.

Means for cutting or severing the film material after the wrapping operation and for seaming the formed edge, generally designated 21, are provided.

Pressing means 22 are arranged to descend onto the article being packaged during rotation of the rotatable frame assembly as described below in order to hold the article in place during the wrapping operation. The pressing means 22 are mounted to a frame member 23 which is fixed to the frame structure 11.

Figure 2:
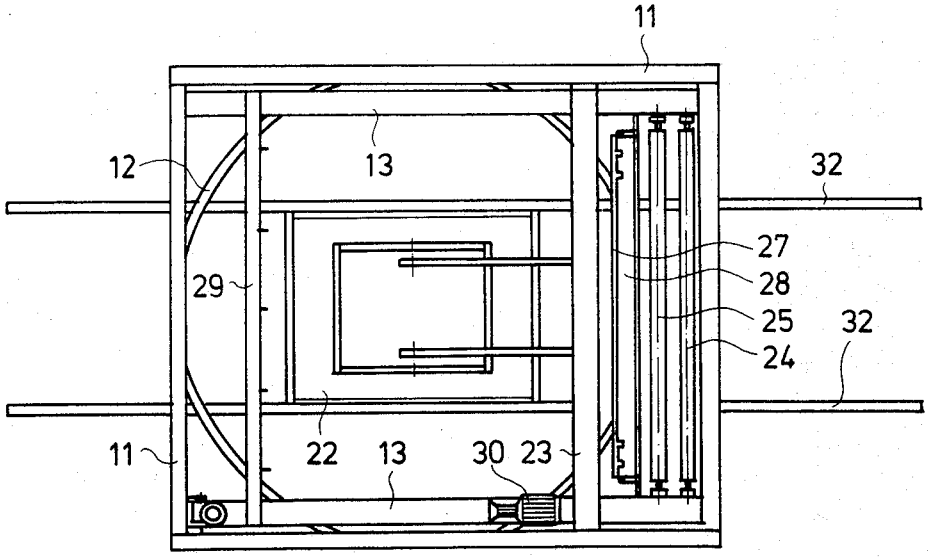
FIG. 2 is a top plan view of the apparatus illustrated in FIG. 1 with some of the components illustrated in FIG. 1 being omitted for the sake of clarity.

A topside film roll 26 is mounted on the frame as seen in FIG. 1 from which film material is drawn and cut for covering the top of the article being packaged as described below. A gripping and pulling device 29 (FIG. 2) is adapted to engage film material drawn from the topside film roll 26 and an idler roll 24 and traction roll 25 function to maintain the film material drawn from the roll 26 in tension. A film material cutter 27 for cutting off the topside film material at an appropriate time as discussed below is mounted on the support frame 13 for the rotatable frame assembly 12. Drive means 31 are mounted on the support frame 13 for the rotatable frame assembly 12 for driving the gripping and pulling means 29 for the topside film material roll 26.

According to an important feature of the invention, the rotatable frame assembly 12 is mounted for reciprocating movement in up and down directions so that the rotatable frame assembly 12 can be selectively raised and lowered during operation. In this connection, drive means 30 (FIG. 2) are provided for raising and lowering the support frame 13 for the rotatable frame assembly 12 within the frame structure 11.

Means 32 for conveying articles to be packaged into the apparatus 10 are provided. The means 32 may take the form of a roller track, conveyor track or the like by means of which the articles to be packaged are transported into the frame structure 11 of apparatus 10. One or more photocells 33 are mounted on the frame structure 11 as shown in FIG. 1. The photocells 33 function as described below to measure the height of the article to be packaged and for indexing successive articles into the packaging apparatus.

The operation of apparatus 10 will now be described. An article to be packaged is conveyed by conveyor means 32, such as on a pallet, into the region monitored by the photocells 33. The photocells 33 determine the height of the article to be packaged and send a signal to appropriate control apparatus whereby the support frame 13 for the rotatable frame assembly 12 is automatically adjusted to the proper height. The article carrying pallet is then moved into the apparatus 10 whereupon the photocells 33 terminate the movement of the pallet substantially in the center of apparatus 10.

At this time, the pressing device 22 descends onto the top of the article to hold the same in place. Thereafter, the support frame 13 carrying the rotatable frame assembly 12 descends to an appropriate height whereupon the frame assembly 12 begins rotating through the actuation of motor 14. At this time the initial end of the film material engaged by gripping means 20 is lifted and applied against the side of the article being packaged. Ater the first wrapping turn of the article, the film material is released from the gripping device 20 and the lower courses of the film material are wrapped around the article as the rotatable frame assembly continues its rotation. After a predetermined number of layers of film material have been wrapped around the article, rotation of the frame assembly 12 is terminated whereupon the support frame 12 descends a certain distance. The pressing device 22 is then raised and the topside film material is pulled from the film roll 26 over the article being packaged and is then cut by the cut-off means 27 which may comprise, for example, a heated resistance wire. The claws of the topside film gripping and pulling means 29 are then disengaged from the topside film material which is allowed to descend onto the article whereupon the pressing means 22 again descends onto the cut piece of film material resting on the top of the article to thereby press the topside film material down onto the article top. Rotation of the rotatable frame assembly 12 is then reinitiated to wrap the upper courses of film material around the article. After the rotation of film roll 18 has ceased, the gripping means closes impacting against the film material whereupon the cut-off and seaming means 29 is actuated and pressing means 22 is raised to its top position. The conveyor means 32 are then actuated to convey the packaged article out of apparatus 10.

It is possible to install a label applicator or other marking device for applying desired markings on the article to be packaged on the support frame 13 of the rotatable frame assembly 12, if required.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. Apparatus for packaging articles in film material, comprising:

a first frame structure adapted to receive an article to be wrapped in film material while the article is maintained stationary;

a second non-rotating support frame mounted in said first frame structure for reciprocating movement in up and down directions and means for selectively raising and lowering said second support frame;

a frame assembly rotatably mounted on said second non-rotating support frame so as to be raised and lowered therewith; and means mounted on said second non-rotating support frame for rotating said rotatable frame assembly;

a roll of film material mounted on said rotatable frame assembly; and means mounted on said rotatable frame assemby for maintaning tension in the film material as the film material is payed out from said film material roll.

2. The combination of claim 1 further including pressing means mounted on said first frame structure and arranged to descend onto the article being packed during rotation of said rotatable frame assembly.

3. The combination of claim 1 wherein said tension maintaining means comprise braking and diverting rolls mounted on said rotatable frame assembly.

4. The combination of claim 1 further including a topside film roll, means for gripping and pulling topside film material from said topside film roll over the article being packaged and means for cutting the topside film material.

5. The combination of claim 1 further including gripping means mounted on said non-rotating reciprocable support frame for selectively engaging and releasing film material during rotation of said rotatable frame assembly.

6. The combination of claim 1 further including means mounted on said rotatable frame assembly for cutting the film material and for seaming the cut end thereof.

* * * * *

US004587796B1

REEXAMINATION CERTIFICATE (3399th)

United States Patent [19] [11] B1 4,587,796

Haloila [45] Certificate Issued Dec. 23, 1997

[54] PACKAGING MACHINE

[75] Inventor: Matti Haloila, Mynämäki, Finland

[73] Assignee: Newtec International S.A., Aix-les-Bains Cedex, France

Reexamination Request:
No. 90/004,456, Nov. 19, 1996

Reexamination Certificate for:

| | |
|---|---|
| Patent No.: | **4,587,796** |
| Issued: | **May 13, 1986** |
| Appl. No.: | **602,007** |
| Filed: | **Apr. 19, 1984** |

[30] Foreign Application Priority Data

Apr. 21, 1983 [FI] Finland ..... 831375

[51] Int. Cl.[6] ..... B65B 13/04

[52] U.S. Cl. ..... 53/588; 53/176

[58] Field of Search ..... 53/587, 588, 589, 53/556, 441, 504, 218, 219, 211, 176, 449

[56] References Cited

U.S. PATENT DOCUMENTS

| | | | |
|---|---|---|---|
| 2,845,763 | 8/1958 | Wonsidler | 53/157 |
| 4,109,445 | 8/1978 | Shulman | 53/588 |
| 4,232,501 | 11/1980 | Stackhouse | 53/441 |
| 4,432,185 | 2/1984 | Geisinger | 53/587 |
| 4,450,668 | 5/1984 | Grossi | 53/449 |

FOREIGN PATENT DOCUMENTS

| | | | |
|---|---|---|---|
| 0022135 | 1/1981 | European Pat. Off. | 53/211 |
| 47739 | 3/1974 | Finland . | |
| 2493802 | 5/1982 | France | 53/587 |
| 2348768 | 6/1974 | Germany | 53/504 |

*Primary Examiner*—James F. Coan

[57] ABSTRACT

Apparatus for packaging articles in film material includes a frame structure and a mechanism for wrapping film material around a stationary article received in the frame structure. The mechanism includes a rotatable frame assembly mounted for rotation in the frame structure and apparatus for rotating the same. A roll of film material is mounted on the rotatable frame assembly along with braking and diverting rolls. A gripping device is provided to selectively engage and release the film material during rotation of the rotatable frame assembly. The rotatable frame assembly is itself mounted in a support frame arranged in the frame structure for reciprocating movement in up and down directions, i.e., the support frame carrying the rotatable frame assembly can be raised and lowered. A cut-off and seaming device is provided for cutting the film material and for seaming or affixing the cut-off end thereof. A pressing device is arranged to be descendable onto the article being packaged.

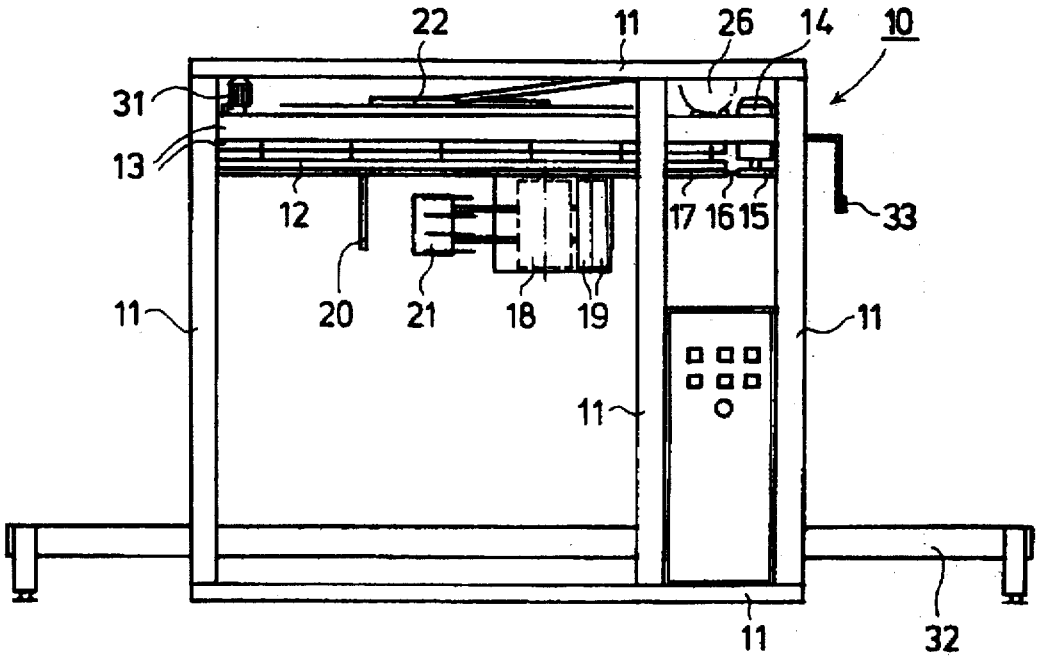

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1–3, 5 and 6 are determined to be patentable as amended.

Claim 4, dependent on an amended claim, is determined to be patentable.

New claims 7–17 are added and determined to be patentable.

1. Apparatus for packaging articles in film material, comprising:

a first *stationary* frame structure *comprising a plurality of vertical components defining a surrounding perimeter about a wrapping station* adapted to receive an article to be wrapped in film material while [the] *said* article is maintained stationary;

a second non-rotating support frame mounted in said first *stationary* frame structure [for] *in such a manner as to be guided by said plurality of vertical components of said first stationary frame structure as said second non-rotating support frame undergoes* reciprocating [movement] *vertical movements* in [up] *upward* and [down] *downward* directions [and] *with respect to said first stationary frame structure;* means for selectively raising and lowering said second *non-rotating* support frame *with respect to said first stationary frame structure*;

a *third* frame assembly rotatably mounted on said second non-rotating support frame so as to be raised and lowered [therewith] *along with said second non-rotating support frame with respect to said first stationary frame structure*; [and]

means mounted on said second non-rotating support frame for rotating said *third* rotatable frame assembly;

a roll of film material mounted on said *third* rotatable frame assembly; and means mounted on said *third* rotatable frame assembly for maintaining tension in [the] *said* film material as [the] *said* film material is [payed] *paid* out from said *roll of* film material [roll].

2. The combination of claim 1, further including:

pressing means mounted on said first *stationary* frame structure and arranged to descend *downwardly* onto the article being [packed] *packaged* during rotation of said *third* rotatable frame assembly *so as to maintain the article in place at said wrapping station during the packaging operation.*

3. The combination of claim 1, wherein:

said tension maintaining means comprise braking and diverting rolls mounted on said *third* rotatable frame assembly.

5. The combination of claim 1, further including:

gripping means mounted on said *second* non-rotating reciprocable support frame for selectively engaging and releasing *said* film material during rotation of said *third* rotatable frame assembly.

6. The combination of claim 1, further including:

means mounted on said *third* rotatable frame assembly for cutting [the] *said* film material and for seaming the cut end thereof.

*7. The apparatus as set forth in claim 1, further comprising:*

*powered conveyor means for conveying an article to be packaged to said wrapping station; and*

*photocell means operatively connected to said second non-rotating support frame and to said powered conveyor means for moving said second non-rotating support frame, and said third rotatable frame assembly rotatably mounted thereon, to a proper elevational level with respect to the article to be packaged so that said film material may be properly wrapped about the article to be packaged, and for terminating movement of said powered conveyor means so that the article to be packaged is properly located at said wrapping station.*

*8. Apparatus for packaging articles in film material, comprising:*

*a first stationary frame structure comprising a plurality of vertical components defining a surrounding perimeter about a wrapping station at which an article is to be wrapped in film material while said article is maintained stationary, and a plurality of horizontal components interconnecting said vertical components;*

*a second non-rotating support frame mounted in said first stationary frame structure in such a manner as to be guided by said plurality of vertical components of said first stationary frame structure as said second non-rotating support frame undergoes reciprocating vertical movements in upward and downward directions with respect to said first stationary frame structure;*

*means for selectively raising and lowering said second non-rotating support frame with respect to said first stationary frame structure;*

*a third frame assembly rotatably mounted on said second non-rotating support frame so as to be raised and lowered along with said second non-rotating support frame with respect to said first stationary frame structure;*

*means mounted on said second non-rotating support frame for rotating said third rotatable frame assembly;*

*a roll of film material mounted on said third rotatable frame assembly; and*

*means mounted on said third rotatable frame assembly for maintaining tension in said film material as said film material is paid out from said roll of film material.*

*9. The combination of claim 8, further comprising:*

*pressing means mounted on said first stationary frame structure for descending downwardly onto the article being packaged during rotation of said third rotatable frame assembly so as to maintain the article in place at said wrapping station during the packaging operation.*

*10. The combination of claim 8, wherein:*

*said tension maintaining means comprises a braking roll mounted on said third rotatable frame assembly.*

*11. Apparatus as set forth in claim 8, further comprising:*

*topside film roll means mounted on said second non-rotatable support frame for providing a topside film*

*which is adapted to be disposed over the article being packaged at said wrapping station.*

*12. The apparatus as set forth in claim 8, further comprising:*

*powered conveyor means for conveying an article to be packaged to said wrapping station; and*

*photocell means operatively connected to said second non-rotating support frame and to said powered conveyor means for moving said second non-rotating support frame, and said third rotatable frame assembly rotatably mounted thereon, to a proper elevational level with respect to the article to be packaged so that said film material may be properly wrapped about the article to be packaged, and for terminating movement of said powered conveyor means so that the article to be packaged is properly located at said wrapping station.*

*13. Apparatus for packaging articles in film material, comprising:*

*a first stationary frame structure comprising first upstanding components defining a surrounding perimeter about a wrapping station at which an article is to be wrapped in film material while said article is maintained stationary, and second components interconnecting said first upstanding components and disposed above said wrapping station;*

*a second non-rotating support frame mounted in said first stationary frame structure in such a manner as to be guided by said first upstanding components of said first stationary frame structure as said second non-rotating support frame undergoes reciprocal vertical movements in upward and downward directions with respect to said first stationary frame structure;*

*means for selectively raising and lowering said second non-rotating support frame with respect to said first stationary frame structure;*

*a third frame assembly rotatably mounted on said second non-rotating support frame so as to be raised and lowered along with said second non-rotating support frame with respect to said first stationary frame structure;*

*means mounted on said second non-rotating support frame for rotating said third rotatable frame assembly;*

*a roll of film material mounted on said third rotatable frame assembly; and*

*means mounted on said third rotatable frame assembly for maintaining tension in said film material as said film material is paid out from said roll of film material.*

*14. The apparatus as set forth in claim 13, further comprising:*

*pressing means mounted on one of said second components of said first stationary frame structure for descending downwardly onto the article being packaged during rotation of said third rotatable frame assembly so as to maintain the article in place at said wrapping station during the packaging operation.*

*15. The apparatus as set forth in claim 14, wherein:*

*said tension maintaining means comprises a braking roll mounted on said third rotatable frame assembly.*

*16. Apparatus as set forth in claim 14, further comprising:*

*topside film roll means mounted on said second non-rotatable support frame for providing a topside film which is adapted to be disposed over the article being packaged at said wrapping station.*

*17. The apparatus as set forth in claim 13, further comprising:*

*powered conveyor means for conveying an article to be packaged to said wrapping station; and*

*photocell means operatively connected to said second non-rotating support frame and to said powered conveyor means for moving said second non-rotating support frame, and said third rotatable frame assembly rotatably mounted thereon, to a proper elevational level with respect to the article to be packaged so that said film material may be properly wrapped about the article to be packaged, and for terminating movement of said powered conveyor means so that the article to be packaged is properly located at said wrapping station.*

* * * * *